United States Patent [19]

Kuparinen

[11] 4,095,907

[45] Jun. 20, 1978

[54] COVER FOR SCRIBER

[75] Inventor: Lasse Kuparinen, Hamburg, Germany

[73] Assignee: Koh-I-Noor Rapidograph, Inc., Bloomsbury, N.J.

[21] Appl. No.: 725,618

[22] Filed: Sep. 22, 1976

[30] Foreign Application Priority Data

Sep. 25, 1975 Germany ..... 2542734
Sep. 25, 1975 Germany ..... 7530355[U]

[51] Int. Cl.[2] ..... B43K 5/18
[52] U.S. Cl. ..... 401/225; 401/242
[58] Field of Search ..... 401/225, 229, 242

[56] References Cited

U.S. PATENT DOCUMENTS 637,439 11/1899 Wolter ..... 401/225 X
2,521,657 9/1950 Severy ..... 401/242X

*Primary Examiner*—Stephen C. Pellegrino
*Attorney, Agent, or Firm*—David H. Semmes

[57] ABSTRACT

A capillary writing pen of the type having an expansion or compensation chamber intermediate the ink reservoir and ambient air. The expansion chamber is improved such that inadvertent flowing of ink reservoir to the capillary pen tip due either to pressure or temperature changes is avoided. The interior wall of the expansion chamber is profiled as a contiguous series of transverse indentations which provide successive expansion areas for entrapment of air and constrictive areas where menisci of ink are formed. The forming of the menisci entraps air bubbles within the ink and, accordingly, provides increased resistance to capillary flow of ink.

2 Claims, 5 Drawing Figures

COVER FOR SCRIBER

CROSS REFERENCES TO RELATED APPLICATIONS

The present application is based upon and claims priority of applicant's earlier filed West German application, as follows:

| Serial No. | Filing Date |
|---|---|
| P 25 42 734.3 | September 25, 1975 |
| G 75 30 355.8 | September 25, 1975 |

BACKGROUND OF THE INVENTION (1) Field of the Invention

The invention relates to an India ink compensating chamber for capillary drafting pens. The compensating chamber serves as an expansion chamber between the India ink reservoir within the pen and the surrounding air.

The India ink compensating chamber in the case of capillary drafting pens in the event of an increase of inside pressure, absorbs India ink within an inside bore and/or with the India ink reservoir, such that India ink will not be forced out of the capillary writing tip due to excessive pressure. Furthermore, ambient air reaches the inside bore and the India ink reservoir by way of the India ink compensating chamber, whenever an underpressure develops in said reservoir due to consumption of India ink or a lowering of ambient temperature.

(2) Description of the Prior Art

West German AS 1,561,857

OS 2,216,015

OS 1,911,950

The conventional spiral-shaped India ink exchange chambers forming a capillary (German AS 1,561,857, German OS 2,216,015) have well fulfilled the aforementioned tasks per se and are used at the present time in the most varied types of capillary drafting pens. It is true, however, that these India ink compensating chambers, due to their capillary shape, as well as the necessarily fine capillaries formed on the edges of the compensating chambers, as a result of the attaching thread and pen cover, are inclined to suck the India ink out of the reservoir and forward into the compensating chamber, that is to say undefined capillary forces develop.

These previously known India ink compensating chambers have moreover the disadvantage that only a single border surface is formed between the India ink and the air, which, in case of an aeration or expansion process, must be removed. The size of the meniscus radius forming in the ink within the compensating chamber and thus the resistance in case of the aeration or expansion process is given as the result of the geometrical cross-section of the India ink compensation chamber. This resistance is very slight in the case of the previously known systems. Also, it is not possible to increase this resistance by decreasing the cross-section of the India ink compensation chamber, since capillary forces then occur, as a result of which the India ink is sucked into the India ink compensation chamber, that is to say the resistance becomes even slighter.

SUMMARY OF THE INVENTION

Therefore, it is an object of the present invention to create a progressively acting India ink compensating chamber with a high resistance against the undesired and uncontrolled leakage of India ink.

According to the invention this will be achieved with an India ink compensating chamber of the conventional type, modified so that in at least one part of the India ink compensating chamber, its cross-sectional surface changes several times in the direction of axial flow between a maximum and a minimum value and as an insurance preferably periodically, whereby the minimum value lies in the capillary range.

This change of the cross-sectional surface can be achieved due to the fact that a limiting surface of at least one part of the India ink compensation chamber in the direction of axial flow and in vertical cross-section has the shape of an undulatory line, especially of undulatory line having a triangular profile.

In an India ink compensation chamber developed in such a way, one will achieve several menisci, that is to say several border surfaces will form between India ink and ambient air, whenever the India ink in the India ink compensation chamber is forced away forwardly or axially and, therefore, away from the India ink reservoir, so that the India ink will fill successively areas of constricted and expanded cross-sectional surfaces. In the areas of an expanded cross-sectional surface, air customarily remains enclosed. The above-mentioned additional menisci will form, thusly, between this air in the areas of expanded cross-section and the areas of decreased cross-sectional surface. As a result of this greater number of menisci that is border surfaces, the resistance to aeration and resistance to expansion of the India ink through unwanted axial flow will be increased.

By properly dimensioning the distances between adjacent cross-sectional surfaces with a minimal value, it will be possible to influence the shape of the menisci, that is to say to produce flattened menisci which contribute to a further increase of the resistance.

An India ink compensation chamber has also been known already (German OS 1,911,950), which has been provided only on a part of the periphery of the cylindrical body and which connects with an opening lying in the axial direction of the cylindrical body further behind and leads to the India ink reservoir with the ambient air by way of its front end. This India ink compensation chamber therefore does not run spirally or meander-shaped around the periphery of the cylindrical body but in zig-zag form and only over a part of its periphery.

Starting out from such an India ink compensating chamber which occupies only a part of the periphery of the cylinder, the India ink compensation chamber of the present invention in a preferred embodiment consists of a series of contiguous indentation axially disposed within the wall of the cylindrical body, the variable cross-sectional surfaces formed by the indentations run always transversely in the direction of the periphery and perpendicularly to the longitudinal axis of the cylindrical body.

The invention will be explained in more detail in the following drawings showing the embodiments in a schematic and simplified way.

DESCRIPTION OF THE PREFERRED EMBODIMENT

Figure 1:
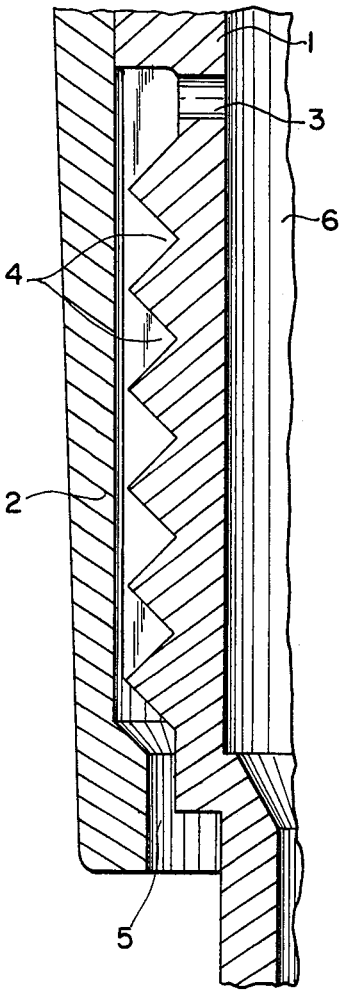
FIG. 1 shows a fragmentary vertical cross-section through the front area of a capillary writing pen, according to the invention.

FIG. 1 shows a part of the cylindrical body 1 into which the capillary tube, which has not been shown, is inserted at the front or bottom and which has an inside bore 6 being connected with the India ink reservoir, likewise not shown, into which inside bore a conventional falling weight, with cleaning wire extending forwardly to the capillary tube, may be inserted.

Cylindrical body 1 is surrounded in a sealing manner by a casing 2, which is secured in a known manner onto the cylindrical body 1 front or bottom.

Figure 2:
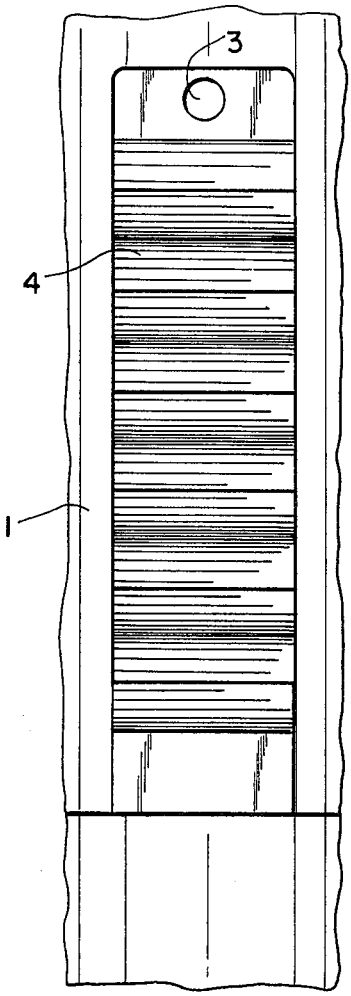
FIG. 2 shows a side plan, showing the series of contiguous indentations forming the India ink compensation chamber and provided in the cylindrical body of the pen with the cap removed.

In the wall of the cylindrical body a series of contiguous indentations have been provided which form the India ink compensation chamber 4 which at the front or bottom, is connected via an area 5 with ambient air and in the rear by way of an opening 3 with the inside bore 6 and thus with the India ink reservoir. The inner surface of the India ink compensation chamber 4 is formed axially in the direction of flow, in a cross-section or profile, corresponding to a triangular wave, as can be gathered from FIG. 1, whereby the individual indentations and elevations developed as a result of this profile run transversely in the direction of the periphery of the cylindrical body 1, as is shown in FIG. 2 and, therefore, perpendicularly to the direction of flow in the India ink compensation chamber 4, as FIG. 1 shows. One will achieve by this profile of the inner surface of the India ink compensation chamber 4, that the depth and thus the cross-sectional surface of the India ink compensation chamber 4 changes in the direction of flow periodically between a maximum and a minimum value. At the same time, the minimum value is in the capillary range.

The India ink flowing through the India ink compensation chamber 4 and the air, thus flow essentially in an axial direction within the capillary writing pen through the India ink compensation chamber 4 and the desired large volume of this India ink compensation chamber will be achieved by the corresponding width of the chamber in the peripheral direction or transversely of the cylindrical body 1.

The India ink flows forwardly through the finest capillaries formed between cover 2 and cylindrical body 1 at the edges of the India ink compensation chamber and as a result it fills successively those interstices between the triangular elevation and the casing 2, serving as a cover and between the elevations, so that menisci of India ink develop.

It is therefore quite easily understandable that at the narrowest cross-sectional surface of the India ink compensation chamber 4, places of constriction in flow develop in which air bubbles passing through them are "stretched" and, possibly supported by the sharp-edged development of the inner surface, are split, so that there will be an assurance that no agglomerations of air bubbles into a large and no longer movable air volume will result.

Figure 3:
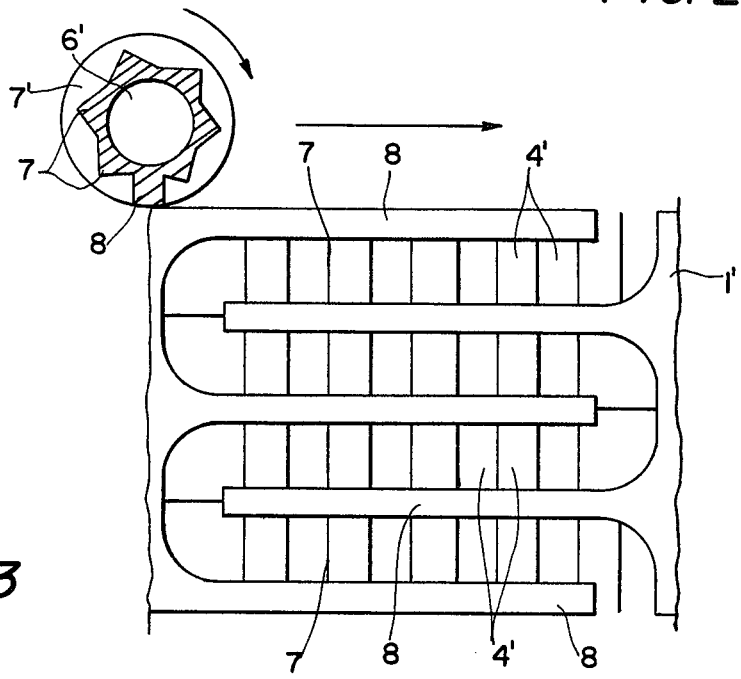
FIG. 3 is a transverse cross-section and exposed view of a modification having an additional India ink compensation chamber within the cylindrical body of the pen.
Figure 4:
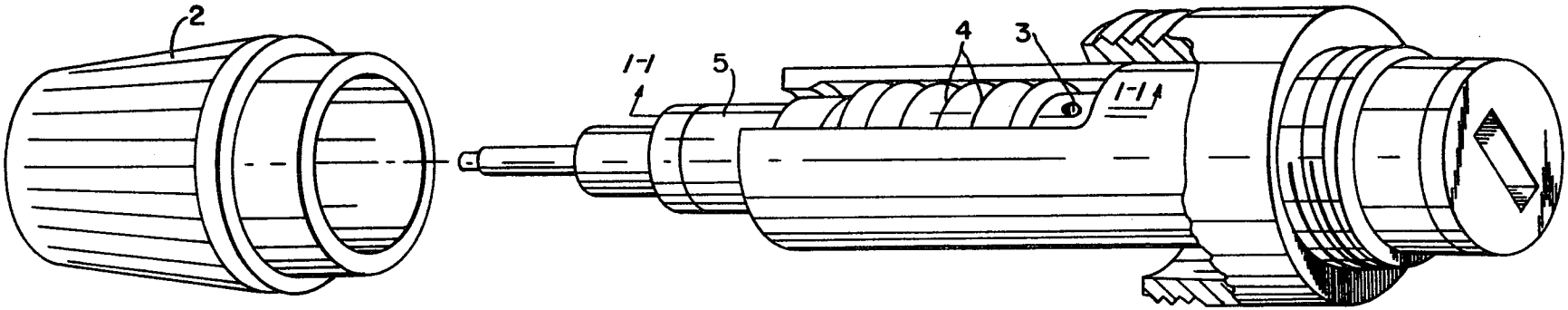
FIG. 4 is an exploded perspective, partially in section, showing a drafting pen nib, with cap removed, according to the species of FIGS. 1 and 2.

In the modification illustrated in FIG. 3 there is a combined presentation of a cylindrical body 1' shown in cross-section 3 and in an unwound shape, whereby parts and areas corresponding to the embodiment according to FIGS. 1 and 2 are designated with the same reference numbers but with an additional expansion area 7.

In FIG. 3 and as can be gathered from the sectional view, said cylindrical body 1' has an inside bore 6' as well as an inner wall area having a series of indentations which form the India ink compensation chamber 4'. At the same time this India ink compensating chamber 4', as results particularly from the sectional view, runs transversely first in the direction of the periphery of the cylindrical body, then axially downwardly in a connecting channel and to another peripheral area of the India ink compensating chamber and then runs transversely in an opposite direction to the area through which it had passed previously, and then again reaches an additional peripheral area of the India ink compensation chamber and then runs transversely in an opposite direction to the area through which it had passed previously, and then again reaches an additional peripheral area of the India ink compensation chamber via a perpendicular connecting channel, and so forth. As the unwinding or exploded view in FIG. 3 shows, the inner wall of the India ink compensation chamber is developed undulating in the same manner as shown in FIGS. 1 and 2, i.e., there are elevations 7 between alternating indentations 4'. The areas of the India ink compensation chamber running in peripheral direction are always separated from one another by separating walls 8.

In the case of this modification of the India ink compensation chamber, the previously mentioned effects are also achieved, therefore, on the one hand the finest capillaries are formed between the cover 2 and the series of indentations 4' which conduct the India ink to the elevated area 7, where the India ink flows because of capillary effect into the middle area of the India ink compensating chamber and forms plural menisci of India ink adjacent the elevated areas 7', so that therefore a considerable resistance against the entry of the India ink into the India ink compensation chamber exists, as well as on the other hand the air bubbles moving through the India ink compensating chamber are "stretched" and split, so that an agglomeration of air bubbles into an immovable, large volume of air will be prevented.

I claim:

1. In a capillary writing pen of the type having an ink reservoir communicable with a writing tip, the improvement comprising:
   - (A) an expansion chamber interconnecting the reservoir and ambient air as a capillary channel apart from the writing tip and having an inner and outer wall for the flow of ink;
     - (i) an inner wall of said chamber having a series of continguous indentations extending transversely such that in cross-section a triangular wave profile is defined with respect to the outer wall of said chamber, and
     - (ii) said indentations further defining within said capillary channel successive areas of expansion and constriction, such that ambient air is entrapped in the areas of expansion and menisci of ink are formed in the areas of constriction.

2. A capillary writing pen as in claim 1, said inner wall of said expansion chamber being formed in the exterior of a writing pen body and said outer wall being formed by means of a cover surrounding said writing pen.

* * * * *